United States Patent [19]

Griesinger

[11] Patent Number: 4,862,502

[45] Date of Patent: Aug. 29, 1989

[54] SOUND REPRODUCTION

[75] Inventor: David H. Griesinger, Cambridge, Mass.

[73] Assignee: Lexicon, Inc., Waltham, Mass.

[21] Appl. No.: 141,212

[22] Filed: Jan. 6, 1988

[51] Int. Cl.[4] ..... H04S 3/00

[52] U.S. Cl. ..... 381/22

[58] Field of Search ..... 381/17, 18, 20, 21, 381/22, 23

[56] References Cited

U.S. PATENT DOCUMENTS

| | | |
|---|---|---|
| 3,772,479 | 11/1973 | Hilbert . |
| 3,786,193 | 1/1974 | Tsurushima . |
| 3,798,373 | 3/1974 | Bauer . |
| 3,812,295 | 5/1974 | Bauer . |
| 3,825,684 | 7/1974 | Ite . |
| 3,829,615 | 8/1974 | Hiramatsu . |
| 3,836,715 | 9/1974 | Ite . |
| 3,934,086 | 1/1976 | Takahashi . |
| 3,944,735 | 3/1976 | Willcocks . |
| 3,959,590 | 5/1976 | Scheiber . |
| 4,027,101 | 5/1977 | DeFreitas . |
| 4,074,083 | 2/1978 | Berkovitz . |
| 4,236,039 | 11/1980 | Cooper . |
| 4,704,728 | 11/1987 | Scheiber . |

FOREIGN PATENT DOCUMENTS

| | | |
|---|---|---|
| 1112233 | 5/1968 | United Kingdom . |

OTHER PUBLICATIONS

Julstrom, "A High Performance Surround Sound Process for Home Video", J. Audio Eng. Soc., vol. 35, No. 7/8, 1987, pp. 536–549.

*Primary Examiner*—Forester W. Isen

[57] ABSTRACT

A directionality enhancement system for converting encoded stereo signals on input channels A and B into four signals on left, center, right and surround output channels.

19 Claims, 3 Drawing Sheets

SOUND REPRODUCTION

This invention relates to sound reproduction systems, and more particularly to systems for converting two channel input signals to four channel output signals.

Dolby stereo is a two track sound format for films that is designed to be played back in a theater through a special decoder that takes the two input channels and separates them into four discrete playback channels; left, right, center and surround. For many years, film sound mixers have specifically prepared their films for playback through this system with monitoring through an encoder and a decoder to be sure that the soundtrack output are as intended. A home decoder system should perform at least as well as a theater decoder system as the small size of the playback room makes errors in the decoding more audible in the home than they are in the theater.

Film sound is composed of three major parts—dialog, music and environmental effects, and sound effects. Dialog is the most important part and by long tradition has been mixed exclusively into the exact center of the playback field. It is desirable, where there is a center speaker, that the decoder direct the dialog to the center speaker and remove it from left and right speakers. This greatly enhances the intelligability of the dialog.

The music component is normally mixed so that it appears to come from the front with substantial reverberation or ambiance from the surround. For special effects, music can be encoded to come from all around the listener or even from behind. That sound component has substantial spread across the front of the load speaker array.

The third sound component—effects—can be reproduced from any direction around the listener and it is desirable that the decoder reproduce that component as closely as possible to the intended direction—that is, effects which visually appear left are put on the left channel, effects which visually appear right area put on the right channel, center effects are mixed equally to left and right and effects which appear on the surround are mixed equally in left and right but out of phase.

When music and dialog occur at the same time, the center (dialog) channel information should be removed from the left and right channels without reducing the spread or loudness of the music. Accuracy of phase and balance of the input channels enhances the preservation of spread while giving excellent dialog rejection in the side and rear channels.

In accordance with one aspect of the invention, there is provided a directionality enhancement system for converting encoded stereo signals on input channels A and B into four signals on left, center, right and surround output channels, respectively, that includes means for attentuating the input signal on the A input channel as a function of the difference of the logs of the signals on the A and B input channels to produce a first attentuated signal, means for attenuating the input signal on the B input channel as a function of the difference of the logs of the signals on the A and B input channels to produce a second attentuated signal, means for attenuating the sum of the input signals on the A and B input channels as a function of the difference of the logs of the sum and difference of the signals on the A and B input channels to produce a third attentuated signals, and means for attenuating the difference of the signals on the A and B input channels as a function of the difference of the logs of the sum and difference of the signals on the A and B input channels to produce a fourth attentuated signal. The system also includes means for combining the signal on the A input channel, the signal on the B input channel, the sum of the signals on the A and B input channels, the difference of the signals on the A and B input channels, and the first, second, third and fourth attentuated signals to produce left, center, right and surround outputs.

The alignment of stereo video machines is such that azimuth can easily be wrong by fifty microseconds or more and vary as the tape or disc is played. Similarly, balance is frequently poor, and can vary by more than one dB between discs or as a disc or tape is played. Typically, decoders have a front panel control for manually adjusting balance and a user should carefully adjust this for each tape for best results. Even when balance is manually adjusted, errors in azimuth remain and steering is compromized. In accordance with another aspect of the invention, there is provided a directionality enhancement system which system checks and corrects both balance and azimuth errors as the film is playing so that the dialog is properly centered and improved steering is obtained.

In a particular embodiment, the system includes first means responsive to a strong centrally-steered signal for comparing the level difference of the input signals on the A and B input channels, gain control means responsive to the first comparing means for adjusting the gain of one of the input channels towards equalization of the levels of the input signals on the A and B input channels; and means responsive to a strong centrally-steered signal for comparing the signal on input channel A with an immediately-preceding sample of the signal on input channel B to provide a first reference signal, and for comparing the same sample of the signal on input channel A with an immediately-succeeding sample of the signal on input channel B to obtain a second reference signal, second means for comparing the first and second reference signals, and delay control means responsive to the second comparing means for adjusting the delay of one of the input channels as a function of the differences between the reference signals to provide azimuth compensation for signals on the A and B input channels.

Performance criteria of the system include:

1. full attenuation of outputs not involved in the reproduction of a steered signal;

2. attenuation is proportional to the magnitude of the direction vector;

3. unsteered signals (or background noise or music in the presence of steering) are minimally disturbed by the steering; and 4. all four directions are treated identically.

Other features and advantages of the invention will be seen as the following description of a particular embodiment progresses, in conjunction with the drawings, in which.

DESCRIPTION OF PARTICULAR EMBODIMENT

Figure 1:
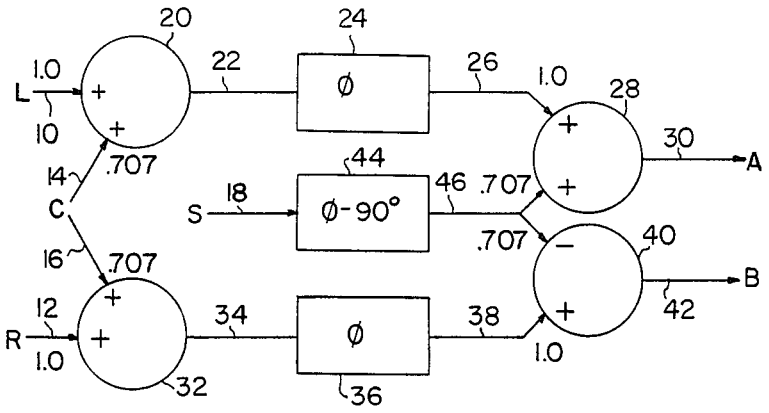
FIG. 1 is a simplified block diagram of an encoder of the Dolby type.

With reference to FIG. 1, a Dolby surround encoder includes L (left) input on line 10, R (right) input on line 12, C (center) inputs on lines 14, 16, and S (surround) input on line 18. The L input and a 0.707 C input are applied to summing circuit 20 and its output is applied on line 22 to phase compensation circuit 24 whose output is applied on line 26 to summing circuit 28 that produces A output on line 30. The R input on line 12 is similarly applied to summing circuit 32 and combined with a 0.707 C input for application on line 34 to phase compensation circuit 36 whose output on line 38 is applied to subtractor circuit 40 which has an output on line 42 as the B signal. The surround signal S on line 18 is applied to phase shift circuit 44 whose output on line 46 is supplied ($\times 0.707$) to summing circuit 28 and subtractor circuit 40 to provide output signals A and B on lines 30, 42, respectively.

Ignoring the phase shift common to all inputs, the encoder shown in FIG. 1 is characterized by the encoding equations:

$$A = L + 0.707C - j0.707S; \text{ and}$$

$$B = R + 0.707C + j0.707S,$$

where the j coefficient denotes an idealized frequency-independent 90° phase shift.

Figure 2:
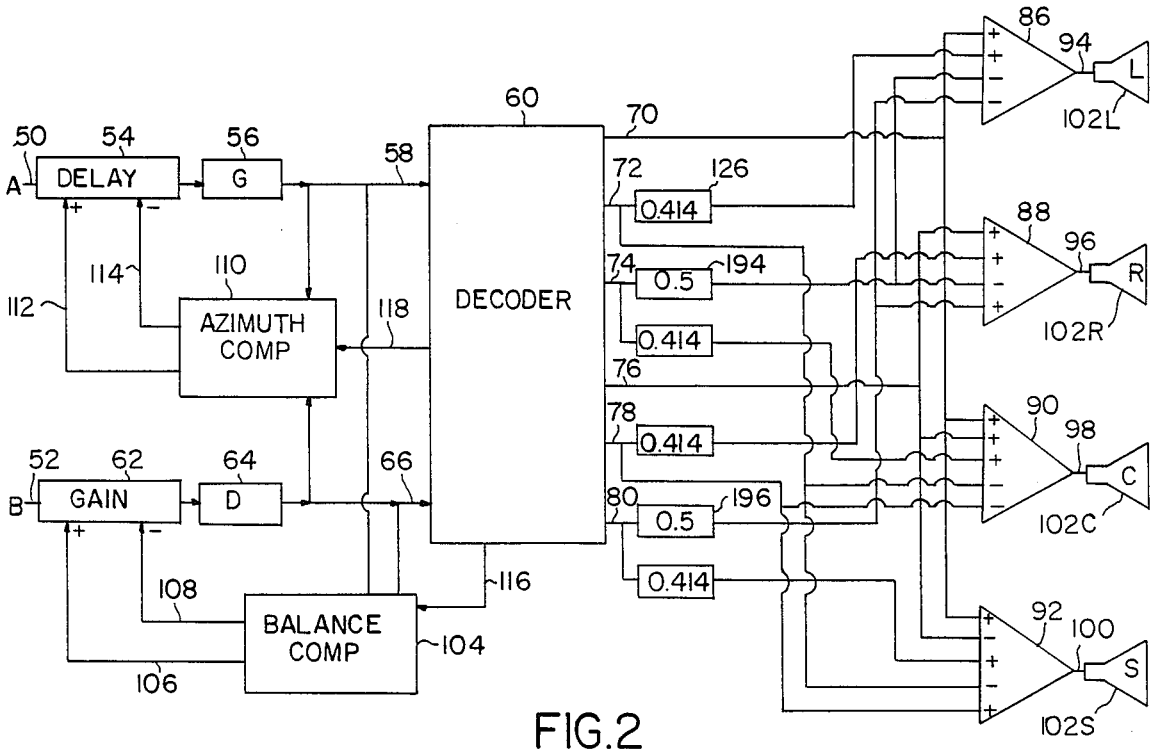
FIG. 2 is a simplified block diagram of a stereo decoder in accordance with the invention.

The A and B signals are applied to the decoder system shown in FIG. 2 on lines 50, 52, respectively. The A signal on line 50 is passed through variable delay circuit 54 and gain circuit 56 for application to input 58 of decoder 60. The B signal on line 52 is passed through variable gain circuit 62 and delay circuit 64 for application to input 66 of decoder 60.

Decoder 60 has an A output line 70, an attenuated $A_a$ output on line 72, a B output on line 76, an attenuated $B_a$ output on line 78, an attenuated $C_a$ output on line 74, and an attenuated $S_a$ output on line 80. Those output signals are applied to a combining matrix that includes combining units 86, 88, 90 and 92, the output of combining units 86 being applied for line 94 to one or more output unit such as loud speaker 102L, the output of combining unit 88 being applied over line 96 to one or more output devices such as loud speaker 102R, the output of combining unit 90 being applied over line 98 to one or more output devices such as loud speaker 102C, and the output of combining unit 92 being applied over line 100 to one or more output devices such as loud speaker 102S. The following table summarizes the inputs to the combining unit 86–92:

| Combining Units | Inputs |
|---|---|
| 86 | $+A$, $+0.414A_a$, $-0.5C_a$, $-0.5S_a$ |
| 88 | $+B$, $+0.414B_a$, $-0.5C_a$, $+0.5S_a$ |
| 90 | $+A$, $+B$, $+0.414C_a$, $-A_a$, $-B_a$ |
| 92 | $+A$, $-B$, $+0.414S_a$, $+B_a$, $-A_a$ |

Connected between lines 58 and 66 are a balance compensation 104 whose outputs 106, 108 are connected to variable gain circuit 62 and azimuth compensation 110 whose outputs are applied over lines 112, 114 to variable delay 54. Decoder 60 has a dialog sensing output on line 116 to balance compensation 104 and a similar dialog sensing output on line 118 to azimuth compensation.

Figure 3:
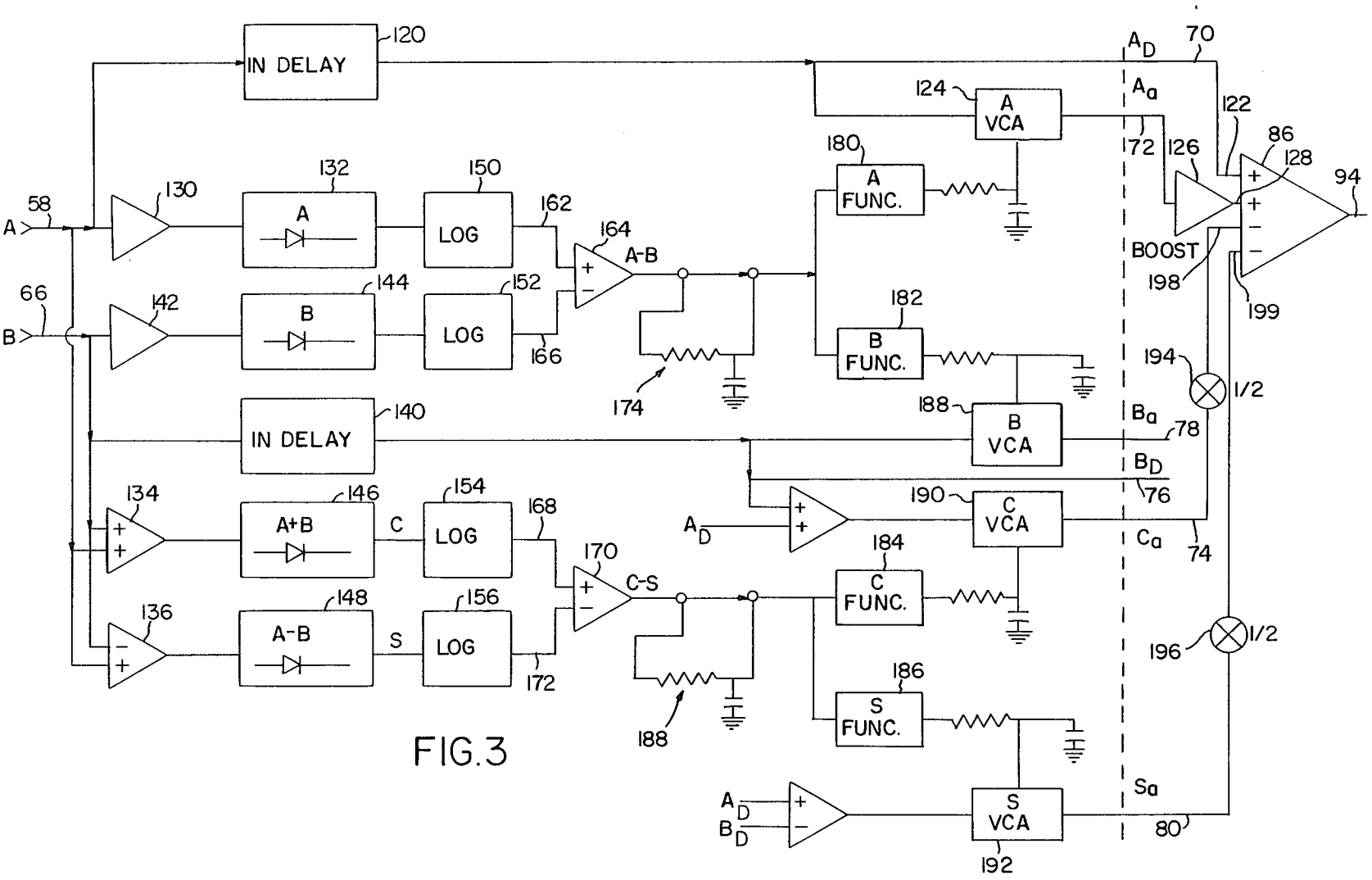
FIG. 3 is a block diagram of decoder logic employed in the decoder system of FIG. 2.

Further details of decoder 60 may be seen with reference to FIG. 3. The signal on line 58 is applied through sixteen millisecond delay 120 to input 122 of combining component 86 whose output is applied on line 94. The output of delay 120 is also applied to attentuator 124 (which may be a voltage controlled amplifier in an analog embodiment or a digital multiplier in a digital embodiment) and its output is applied through 0.414 "boost" amplifier 126 to plus input 128 of combining component 86. In addition, the signal on line 58 is applied through gain control 130 to rectifier 132, to adder 134 and to the positive input of subtractor 136.

The B input signal on line 66 is similarly applied through sixteen millisecond delay 140 to output line 74, gain control 142, adder 134, and to the negative input of subtractor 136. Thus, adder 134 applies the sum of the signals on lines 58 and 66 as a C (center) output signal to recitifier 146 and subtractor 136 applies the difference of those two signals as an S (surround) output to rectifier 148.

Coupled to the output of each rectifier 132, 144, 146 and 148 is a log circuit 150, 152, 154, 156, respectively (which may be look-up tables in a digital embodiment)—the output of log circuit 150 on line 162 being the log of the value of the input signal A that is applied to the positive input of subtractor 164; the output of log circuit 152 on line 166 being the log of the input signal B which is applied to the negative input of subtractor 164; the output of log circuit 154 on line 168 being the log of the sum (C) of those two input signals which is applied to the positive input of subtractor 170; and the output of log circuit 156 on line 172 being the log of the difference (S) of those two input signals and applied to the negative input of subtractor 170. Connected to the output of each subtractor 164, 170 is a switched time constant arrangement 174 for selectively inserting a delay, (for example one hundred millisecond). The output of subtractor 164 is applied to function circuits 180 and 182 (which may be look-up tables in a digital embodiment) while the output of subtractor 170 is applied to function circuits 184, 186.

The output of subtractor 164 (A–B) as modified by function circuit 180 is applied to attentuator 124 to provide a steering control ($A_a$) output on line 72; and through function circuit 182 to similarly control attenuation via attenuator 188 of the B input to provide a second steering control ($B_a$) output on line 76.

The log difference signal (C−S) from subtractor 170 is applied through time constant network 188 to function circuits 184 and 186 to modify respectively the C signal applied to attenuator 190 and the S signal applied to attenuator 192. The steering control signals $C_a$ and $S_a$ on lines 74 and 80 are applied through 0.5 amplification stages 194, 186 to inputs 198, 199, respectively, of combining unit 86. Function circuits 180, 182, 184 and 186 are preferably implemented such that smooth steering and complete cancellation in outputs are obtained while preserving the energy of both the steered and unsteered signals.

The system also includes automatic gain control (AGC) of the input signals. In an analog implementation, analog peak detectors and rectifiers may be used which continuously follow the input signals while in a digital implementation, level signals may be read periodically and adjusted appropriately.

Figure 4:
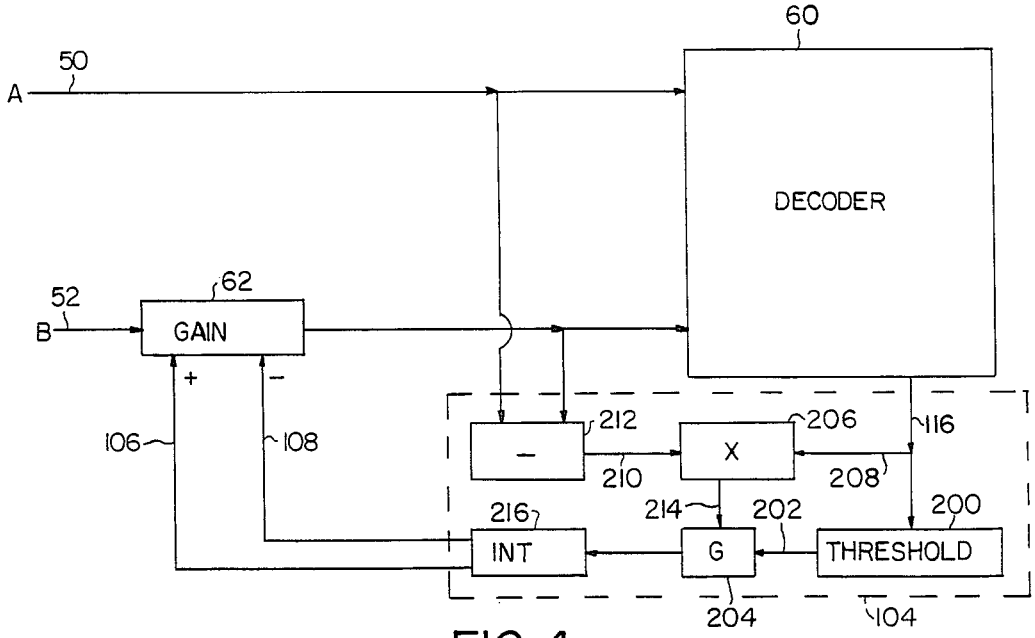
FIG. 4 is a block diagram of balance compensation employed in the decoder system of FIG. 2.

Further details of the balance compensation may be seen with reference to FIG. 4. As indicated in that Figure, threshold unit 200 in response to a strong centrally-steered signal output on line 116 (when the log difference of C−S is at least six dB) provides an output on line 202 to condition gate circuit 204. That log difference signal is also applied to multiplier 206 over line 208. A second input to multiplier 206 (on line 210) is the level difference between the A and B input signals as provided by subtractor 212. The output of multiplier 206 on line 214 is applied through gate 204 to integrator 216. Integrator 216 is tested periodically, and if its value is negative, a signal on line 108 is applied to gain control circuit 62 to reduce the gain. Similarly, if the integrator output is positive, a signal on line 106 is applied to gain control circuit 62 to increase the gain.

Figure 5:
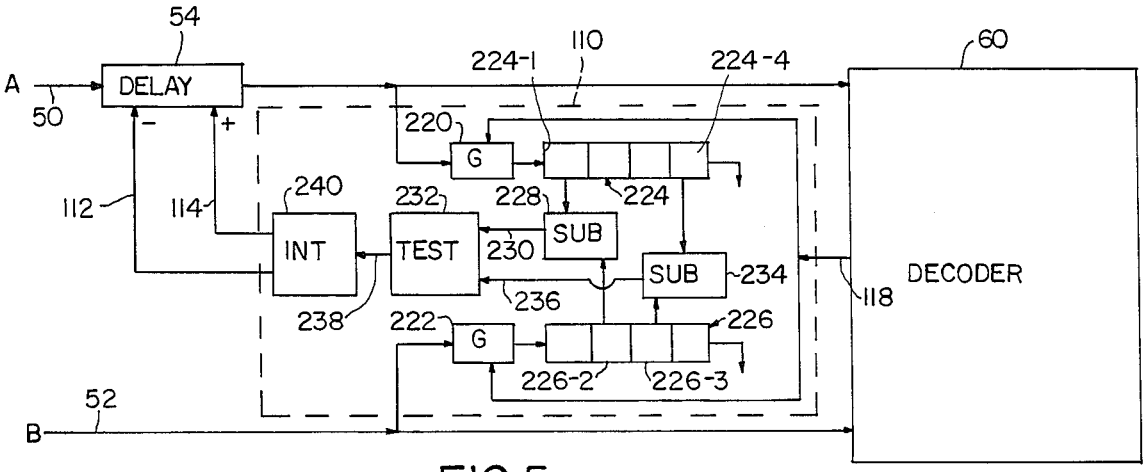
FIG. 5 is a block diagram of azimuth compensation employed in the decoder system of FIG. 2.

Further details of the azimuth compensation may be seen with reference to FIG. 5. In response to a strong center signal (preferably in excess of ten dB), a resulting output on line 118 is applied to corresponding gates 220, 222 to apply successive samples of the input A and B signals on lines 50 and 52 to four stage test delay units 224, 226, respectively. A sample of the B input on line 52 (delay stage 226-2) is compared with the immediately-following sample on line 50 (delay stage 224-1) by subtractor 228 whose output is applied to over line 230 to test circuit 232. During the next time interval, the same B input sample from line 52 is supplied from delay stage 226-3 and subtracted from the immediately-preceding A input sample from delay stage 224-4 by subtractor 234 and applied over line 236 to test circuit 232. The resulting bias signal (if any) on line 238 is applied to integrator 240 and if there is a consistent bias, delay 54 is adjusted appropriately, a signal on line 112 increasing the delay and a signal on line 114 decreasing the delay. The system thus continually monitors level and phase and provides adjustment as necessary in response to strong dialog (centrally steered) inputs to provide balance and azimuth compensation and improved steering accordingly results.

The system has good "balance" and low time delay "azimuth" between the incoming signals so that unwanted signals are accurately removed and clean steering is produced in the presence of ambiance. If the input signals are accurately balanced and in phase, the system tends to place all the dialog in the center speaker 102C, and dialog in the surround speaker 102S, normally the difference between the left and right inputs, will be zero.

While a particular embodiment of the invention has been shown and described, various modifications thereof will be apparent to those skilled in the art, and therefore it is not intended that the invention be limited to the disclosed embodiment, or to details thereof, and departures may be made therefrom within the spirit and scope of the invention.

What is claimed is:

1. A directionality enhancement system for converting encoded stereo signals on input channels A and B into four signals on left, center, right and surround output channels, respectively, comprising:

means for attentuating the input signal on the A input channel as a function of the difference of the logs of the signals on the A and B input channels to produce a first attentuated signal, means for attenuating the input signal on the B input channel as a function of the difference of the logs of the signals on the A and B input channels to produce a second attenuated signal, means for obtaining the sum of the input signals on the A and B input channels, means for obtaining the difference of the input signals on the A and B input channels;

means for attenuating said sum of the input signals on the A and B input channels as a function of the difference of the logs of the sum and difference of the signals on the A and B input channels to produce a third attenuated signal, means for attenuating said difference of the signals on the A and B input channels as a function of the difference of the logs of the sum and difference of the signals on the A and B input channels to produce a fourth attenuated signal, and means for combining the signal on the A input channel, the signal on the B input channel, the sum of the signals on said A and B input channels, the difference of the signals on the A and B channels, and said first, second, third and fourth attenuated signals to produce left, center, right and surround outputs.

2. The system as claimed in claim 1 and further including means responsive to a strong centrally-steered signal for comparing the level difference of the input signals on said A and B input channels, and gain control means responsive to said comparing means for adjusting the gain of one of said input channels towards equalization of the levels of the input signals on said A and B input channels.

3. The system of claim 1 and further including means responsive to a strong centrally-steered signal for comparing the signal on input channel A with an immediately-preceding sample of the signal on input channel B to provide a first reference signal, and for comparing a sample of said signal in input channel A with an immediately-succeeding sample of the signal on input channel B to obtain a second reference signal, means for comparing said first and second reference signals, and delay control means responsive to said comparing means for adjusting the delay of one of said input channels as a function of the differences between said reference signals to provide azimuth compensation for signals on said A and B input channels.

4. A directionality enhancement system comprising means for converting encoded stereo signals on input channels A and B into four signals on left, center, right and surround output channels, respectively, first means responsive to a strong centrally-steered signal for comparing the level difference of the input signals on said A and B input channels, gain control means responsive to said first means for adjusting the gain of one of said input channels towards equalization of the levels of the input signals on said A and B input channels, means responsive to a strong centrally-steered signal for comparing the signal in input channel A with an immediately-preceding sample of the signal on input channel B to provide a first reference signal, and for comparing a sample of said signal on input channel A with an immediately-succeeding sample of the signal on input channel B to obtain a second reference signal, second means for comparing said first and second reference signals, and delay control means responsive to said second means for adjusting the delay of one of said input channels as a function of the differences between said reference signals to provide azimuth compensation for signals on said A and B input channels.

5. The system of claim 4 wherein said means for converting encoded stereo signals on input channels A and B into four signals on left, center, right and surround output channels, respectively, includes means for obtaining the sum of the signals on the A and B input channels, means for obtaining the difference of the input signals on the A and B channels, means for attenuating the input signal on the A input channel as a function of the difference of the logs of the signals on the A and B input channels to produce a first attenuated signal, means for attenuating the input signal on the B input channel as a function of the difference of the logs of the signals on the A and B input channels to produce a second attentuated signal, means for attenuating said sum of the input signals on the A and B input channels as a function of the difference of the logs of the sum and difference of the signals on the A and B input channels to produce a third attenuated signal, and means for attenuating said difference of the signals on the A and B input channels as a function of the difference of the logs of the sum and difference of the signals on the A and B input channels to produce a fourth attenuated signal, means for combining the signal on the A input channel, the signal on the B input channel, said sum of the signals on the A and B input channels, the difference of the signals on the A and B input channels, and said first, second, third and fourth attenuated signals to produce left, center, right and surround outputs.

6. The system of claim 1 wherein said means for combining includes first combining means for combining said input signal on said A channel with said first attenuated signal modified by a (0.414) factor, said third attenuated signal modified by a (0.5) factor and said fourth attenuated signal modified by a (0.5) factor to produce said left output.

7. The system of claim 6 wherein said first combining means includes means for adding said input signal on said A channel and said modified first attenuated signal, and subtracting said modified third and modified fourth attenuated signals.

8. The system of claim 1 wherein said means for combining includes second combining means for combining said input signal on said B channel with said second attenuated signal modified by a (0.414) factor, said third attenuated signal modified by a (0.5) factor and said fourth attenuated signal modified by a (0.5) factor to produce said right output.

9. The system of claim 8 wherein said second combining means includes means for adding said input signal on said B channel, said modified second attenuated signal and said modified fourth attenuated signal, and subtracting said modified third signal.

10. The system of claim 1 wherein said means for combining includes third combining means for combining said input signals on said A and B channels with said third attenuated signal modified by a (0.414) factor, said first attenuated signal and said second attenuated signal to produce said center output.

11. The system of claim 10 wherein said third combining means includes means for adding said input signals on said A and B channels and said modified third attenuated signal, and subtracting said first and second attenuated signals.

12. The system of claim 1 wherein said means for combining includes fourth combining means for combining said input signals on said A and B channels with said fourth attenuated signal modified by a (0.414) factor, said first attenuated signal and said second attenuated signal to produce said surround output.

13. The system of claim 12 wherein said fourth combining means includes means for adding said input signal on said A channel, said second attenuated signal and said modified fourth attenuated signal, and subtracting said input signal on said B channel and said first attenuated signal to produce said surround output.

14. The system of claim 1 wherein said means for combining includes first combining means for combining said input signal on said A channel with said first attenuated signal modified by a (0.414) factor, said third attenuated signal modified by a (0.5) factor and said fourth attenuated signal modified by a (0.5) factor to produce said left output;

second combining means for combining said input signal on said B channel with said second attenuated signal modified by a (0.414) factor, said third attenuated signal modified by a (0.5) factor and said fourth attenuated signal modified by a (0.5) factor to produce said right output;

third combining means for combining said input signals on said A and B channels with said third attenuated signal modified by a (0.414) factor, said first attenuated signal and said second attenuated signal to produce said center output; and fourth combining means for combining said input signals on said A and B channels with said fourth attenuated signal modified by a (0.414) factor, said first attenuated signal and said second attenuated signal to produce said surround output.

15. The system as claimed in claim 14 and further including means responsive to a strong centrally-steered signal for comparing the level difference of the input signals on said A and B input channels, and gain control means responsive to said comparing means for adjusting the gain of one of said input channels towards equalization of the levels of the input signals on said A and B input channels.

16. The system of claim 15 and further including means responsive to a strong centrally-steered signal for comparing the signal on input channel A with an immediately-preceding sample of the signal on input channel B to provide a first reference signal, and for comparing a sample of said signal on input channel A with an immediately-succeeding sample of the signal on input channel B to obtain a second reference signal, means for comparing said first and second reference signals, and delay control means responsive to said comparing means for adjusting the delay of one of said input channels as a function of the differences between said reference signals to provide azimuth compensation for signals on said A and B input channels.

17. The system of claim 1 wherein said means for combining includes first combining means that includes means for adding said input signal on said A channel and said first attenuated signal modified by a (0.414) factor, and subtracting modified third and fourth attenuated signals, each said modified third and fourth attenuated signals being modified by a (0.5) factor, to produce said left output;

second combining means that includes means for adding said input signal on said B channel, said second attenuated signal modified by a (0.414) factor and a modified fourth attenuated signal, and subtracting a modified third attenuated signal, each said modified third and fourth attenuated signals being modified by a (0.5) factor, to produce said right output;

third combining means that includes means for adding said input signals on said A and B channels and said third attenuated signal modified by a (0.414) factor, and subtracting said first and second attenuated signals to produce said center output; and fourth combining means that includes means for adding said input signal on said A channel, said second attenuated signal and said modified fourth attenuated signal modified by a (0.414) factor, and subtracting said input signal on said B channel and said first attenuated signal to produce said surround output.

18. The system of claim 1 wherein said means for combining includes first combining means for combining said input signal on said A channel with said first attenuated signal modified by a (0.414) factor, said third attenuated signal modified by a (0.5) factor and said fourth attenuated signal modified by a (0.5) factor to produce said left output;

second combining means for combining said input signal on said B channel with said second attenuated signal modified by a (0.414) factor, said third attenuated signal modified by a (0.5) factor and said fourth attenuated signal modified by a (0.5) factor to produce said right output;

third combining means for combining said input signals on said A and B channels with said third attenuated signal modified by a (0.414) factor, said first attenuated signal and said second attenuated signal to produce said center output; and fourth combining means for combining said input signals on said A and B channels with said fourth attenuated signal modified by a (0.414) factor, said first attenuated signal and said second attenuated signal to produce said surround output.

19. The system of claim 5 wherein said means for combining includes first combining means that includes means for adding said input signal on said A channel and said first attenuated signal modified by a (0.414) factor, and subtracting modified third and fourth attenuated signals, each said modified third and fourth attenuated signals being modified by a (0.5) factor, to produce said left output;

second combining means that includes means for adding said input signal on said B channel, said second attenuated signal modified by a (0.414) factor and a modified fourth attenuated signal, and subtracting a modified third attenuated signal, each said modified third and fourth attenuated signals being modified by a (0.5) factor, to produce said right output;

third combining means that includes means for adding said input signals on said A and B channels and said third attenuated signal modified by a (0.414) factor, and subtracting said first and second attenuated signals to produce said center output; and fourth combining means that includes means for adding said input signal on said A channel, said second attenuated signal and said modified fourth attenuated signal modified by a (0.414) factor, and subtracting said input signal on said B channel and said first attenuated signal to produce said surround output.

* * * * *